United States Patent [19]

Bornand

[11] Patent Number: 4,458,598

[45] Date of Patent: Jul. 10, 1984

[54] ASSEMBLY FORMED BY A PROJECTILE AND THE MEANS FOR LAUNCHING THIS PROJECTILE

[75] Inventor: Robert Bornand, Meyrin-Geneva, Switzerland

[73] Assignee: Valinor, S.A., Vaduz, Liechtenstein

[21] Appl. No.: 333,851

[22] PCT Filed: Apr. 22, 1981

[86] PCT No.: PCT/CH81/00044

§ 371 Date: Dec. 16, 1981

§ 102(e) Date: Dec. 16, 1981

[87] PCT Pub. No.: WO82/00512

PCT Pub. Date: Feb. 18, 1982

[30] Foreign Application Priority Data

Aug. 8, 1980 [CH] Switzerland ..... 6021/80

[51] Int. Cl.[3] ..... F41F 7/00; F41F 1/06

[52] U.S. Cl. ..... 102/483; 89/1.816

[58] Field of Search ..... 102/374, 380, 483; 42/1 F; 89/1.813, 1.816, 1.819

[56] References Cited

FOREIGN PATENT DOCUMENTS 375252 3/1964 Switzerland ..... 102/380

572661 10/1945 United Kingdom ..... 102/374

*Primary Examiner*—Charles T. Jordan

*Assistant Examiner*—Ted L. Parr

*Attorney, Agent, or Firm*—Cushman, Darby & Cushman

[57] ABSTRACT

The projectile (1) comprises a head (3) and a tubular tail section (4) carrying fins (5). A piston (6) is fitted inside the tail section so as to form, with the walls of the latter, a closed combustion chamber containing a propellent charge (7). The launching means comprise a cylindrical launching rod (2) which is mounted on a support (12). The rod (2) is hollow and contains a percussion member comprising a percussion pin (14) fast with a percussion rod (13). For launching the projectile, the latter is positioned on the launching rod (2) so that the end of this rod is engaged in the opening of the tubular tail section (4). The free end of the tail section is then centered in relation to the launching rod (2). When the ends of the launching rod (2) and of the piston (6) then come into contact, a centering is likewise produced at this level, because of the cooperation between the guiding surfaces (2') and (6').

This makes possible a perfect centering of the detonator (8) with respect to the percussion pin (14) and enables the piston (6) to be maintained in a coaxial position with respect to the launching rod (2) throughout the propulsion phase.

3 Claims, 5 Drawing Figures

ASSEMBLY FORMED BY A PROJECTILE AND THE MEANS FOR LAUNCHING THIS PROJECTILE

Figure 1:
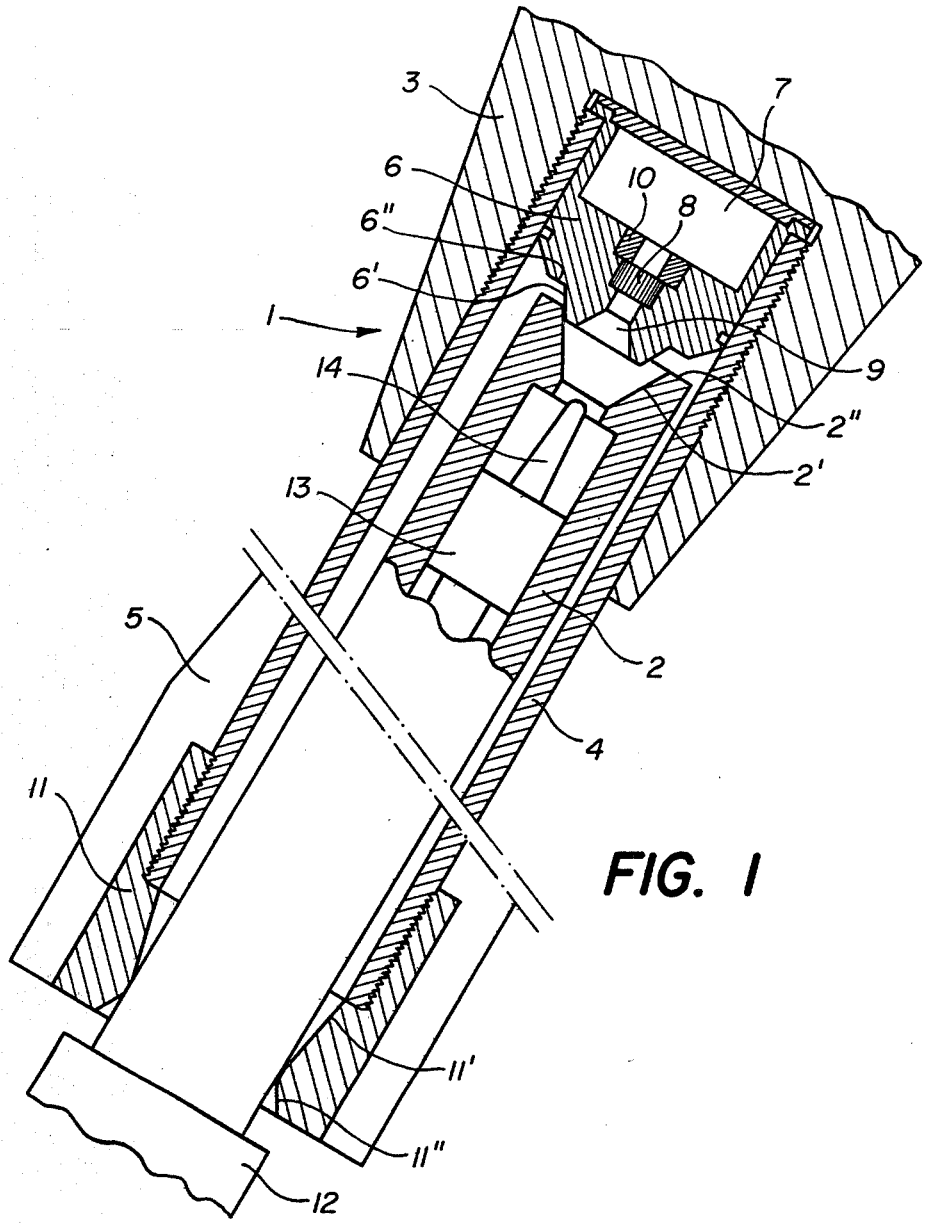

The present invention relates to an assembly formed by a projectile and a means for launching this projectile, the said means comprising a fixed launching rod which comprises a percussion pin at its free end, and the projectile comprising a projectile head, a tubular tail section, of which one end is fixed to the projectile head and the other free end is open, a piston fitted with a primer or fuze and mounted inside the tail section so as to form the movable part of an expansible and closed combustion chamber and a propellent charge disposed inside the said combustion chamber.

In such an assembly, the projectile is placed in position on the launching rod, for the purpose of being launched, in such a manner that the percussion pin is able to act on the primer and that the piston is able to bear on the free propellent charge and of the expansion of the chamber which follows.

The positioning of the projectile or missile is generally carried out manually, either by placing the projectile on the launching rod by introducing the latter into the open end of the tail section, or by introducing the projectile into a launching tube, at the bottom of which is fixed the launching rod, so that the projectile drops on to the said rod and the piston is immobilised in a position similar to that in the first case.

In the two aforementioned cases, the percussion can be externally controlled, the percussion pin then being projected towards the fuze under the effect, for example, of a spring. In the event of the launching being by means of a tube, the percussion can be automatic, that is to say, the dropping of the projectile or missile on to a fixed percussion pin causes the percussion.

The invention has for its object to provide an assembly of the aforementioned type, which permits a very high pressure to be developed in the combustion chamber, while guaranteeing a perfect tightness of this chamber during the combustion and while assuring a very great reliability of the percussion and also a very accurate guiding of the projectile on the launching rod during the propulsion phase.

To this end, the assembly according to the invention is characterised in that the free end of the launching rod has an axially symmetrical guiding surface which is coaxial with respect to the percussion pin, and the piston has an axially symmetrical guiding surface which is coaxial with respect to the primer or fuze and surrounding an opening for the passage of the percussion pin, these guiding surfaces being arranged in such manner as to assure the centering of the percussion pin in relation to the fuze and to participate in the establishment of the coaxial relationship of the projectile and of the launching rod during the propulsion phase.

According to one preferred embodiment, the two guiding surfaces are conical surfaces of equal conicity, the guiding surface of the launching rod being the internal surface of a conical cavity which opens out towards the exterior of the rod and the piston comprising a projecting conical part which forms the guiding surface of the piston.

On the other hand, the launching rod and the piston preferably have planar contact surfaces, perpendicular to the axis of the assembly, which surround the respective guiding surfaces, so as to provide abutment surfaces between the percussion rod and the piston.

A first advantage of the invention consists in that it makes possible a perfect centering of the primer or detonator with respect to the percussion pin and thus in particular the avoidance of the two major risks which result from an eccentric percussion. Firstly concerned is the risk of an eccentric deformation of the primer or detonator located in a compartment of the piston and consequently of an escape of combustion gas at this point, which results in a loss of energy for the propulsion and thus a shortening of the range of the projectile and, in addition, causes noise at the time of launching. Secondly, in an eccentric position, the percussion pin may strike a side wall of the corresponding opening of the piston, so that the energy necessary for causing the percussion may no longer be available at the primer or detonator, this leading to a failure of the percussion. This danger is all the greater when the inclination of the launching device is small relatively to the horizontal.

A second important advantage of the invention results from the piston being maintained in a coaxial position relatively to the launching rod during the whole of the propulsion phase. This permits a very good firing accuracy to be obtained and a uniform distribution of the forces exerted by the piston on the launching rod to be achieved, thus resulting in a better energy yield and a reduction of the wear on the end of this rod.

Figures 2, 3:
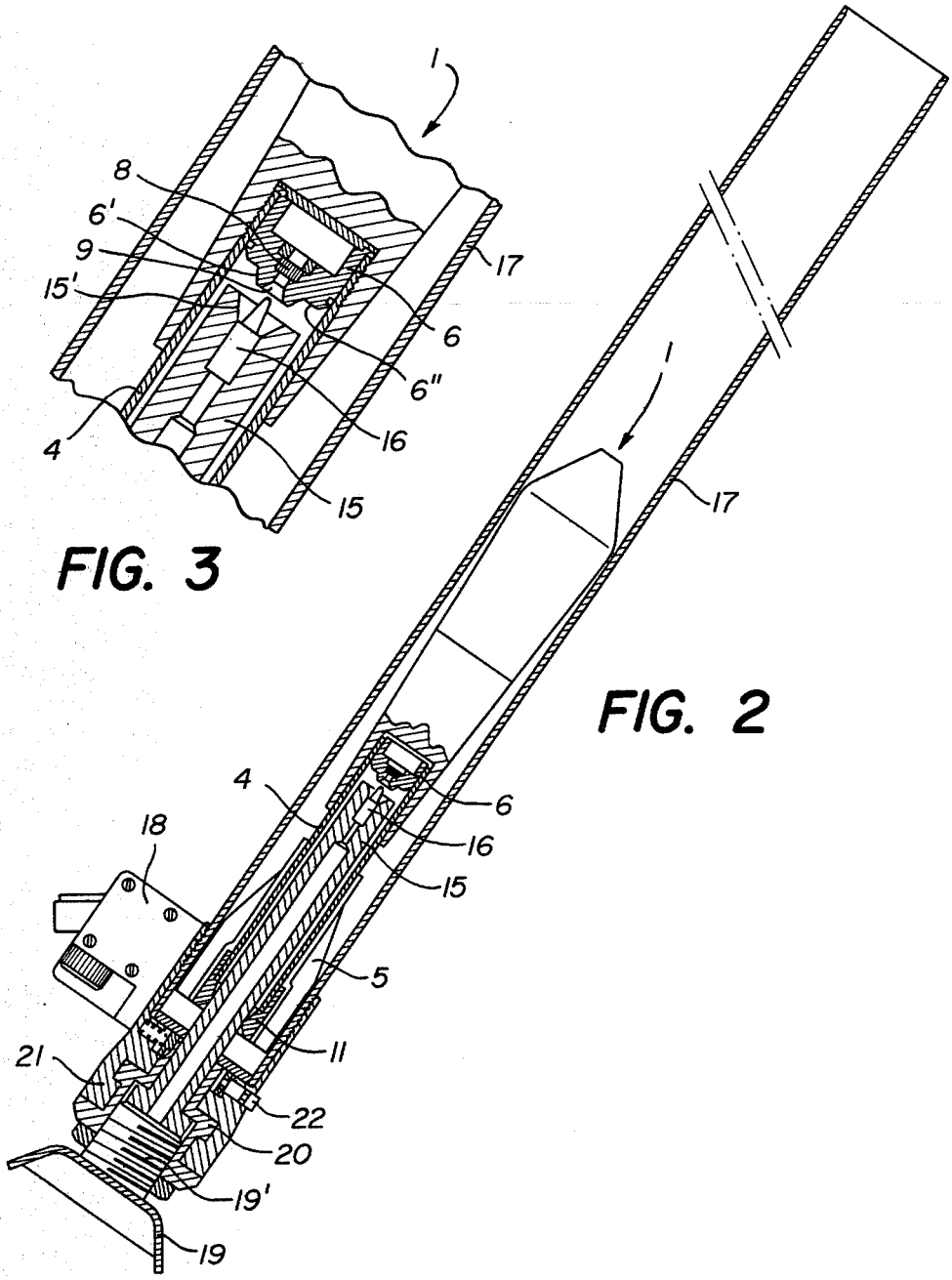
Figure 5:
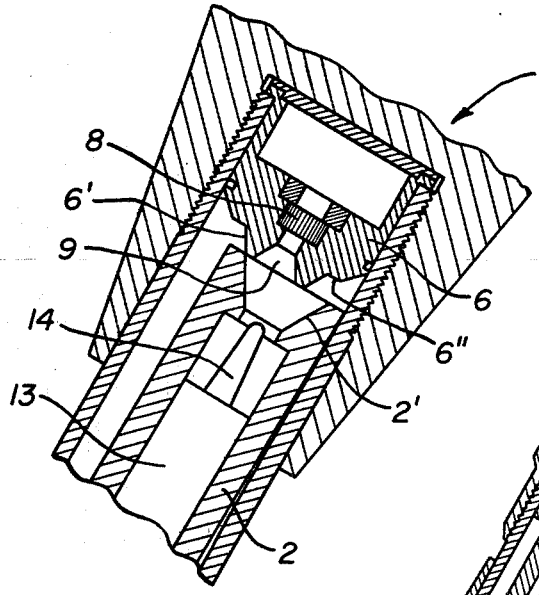
Figure 4:
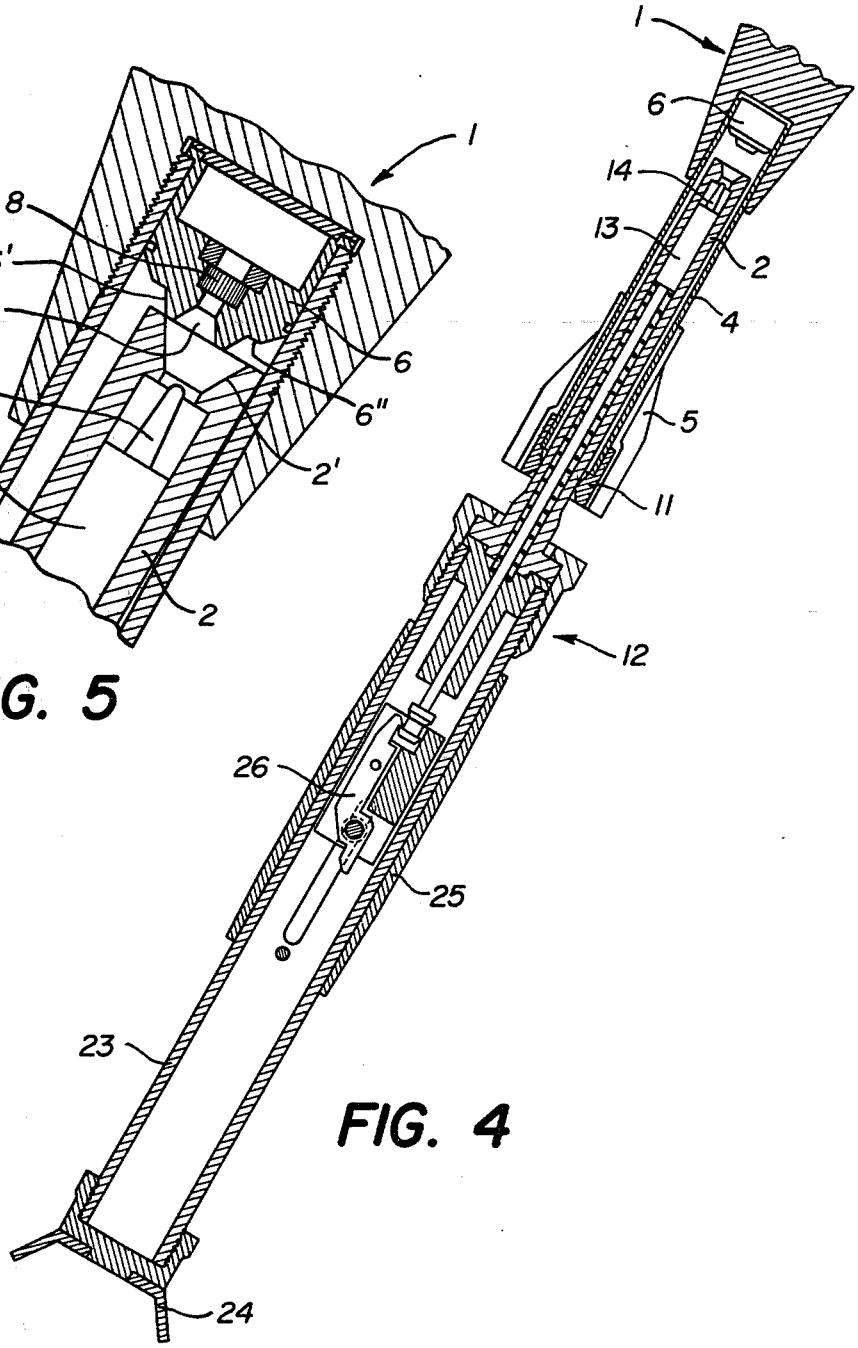

Other advantages and features of the invention will become apparent from the following description given, by way of example, of two variants of one preferred constructional form of the assembly according to the invention. In the accompanying drawing:

FIG. 1 is a view in axial section of an assembly according to the invention, FIG. 2 is a view in axial section of an assembly according to the invention and comprising a launching tube and with automatic percussion, FIG. 3 is a view to a larger scale of the part of FIG. 2 containing the guiding surfaces, FIG. 4 is a view in axial section of an assembly without launching tube, with controlled percussion, and FIG. 5 is an enlarged view of that part of FIG. 4 which contains the guiding surfaces.

FIG. 1 shows a projectile, represented generally by 1, and a launching means 2, 12, in an intermediate relative position which occurs at the time of positioning the projectile on the launching means.

The projectile 1 comprises essentially a head 3 and a tubular tail section 4 which is fixed at one closed end to the head 3 and which carries fins 5 at its other open end. A piston 6 is positioned inside the tail section, so as to form, with the walls of the latter, a closed combustion chamber containing a propellent charge 7. A primer or detonator 8 is fitted in a compartment of the piston behind an opening 9 in the latter, so as to bear on a shoulder surrounding this opening. The detonator is in addition held in its compartment by a crimped ring 10.

FIG. 1 also shows the characteristic form of the surface of the piston surrounding the opening 9 and comprising particularly a frustoconical part 6' and a plane annular part 6''. The detonator 8 formed by a cylindrical capsule, the opening 9 and the surfaces 6' and 6'' are coaxial, their axis also coinciding with that of the piston.

The open end of the tail portion of the projectile comprises a part 11, of which the smaller internal diameter is chosen so as to assure the centering of the end of the projectile in relation to the launching rod 2.

Towards the interior of the tubular part 4, the part 11 has a frustoconical surface 11', which forms a retaining stop for the piston when the latter is displaced in the tubular part 4 following the firing. Towards the exterior, the part 11 also has a frustoconical surface, indicated by 11'' and designated for facilitating the positioning of the projectile on the launching means.

The launching means comprise an essentially cylindrical launching rod 2, which is mounted on a suitable support 12. In the example as illustrated, the rod 2 is hollow and contains a percussion member comprising a percussion pin 14, which is fast with a percussion rod 13 displaceable axially under the effect of a control device (not shown), essentially fitted in the support. The free end of the launching rod 2 has a frustoconical recess 2', of which the rim is formed by an annular flat surface 2''. The launching rod, the percussion pin and the surfaces 2', 2'' are coaxial.

For launching a projectile, the latter is placed in position of the launching rod, so that the end of this rod is engaged in the opening of the tubular tail section. The free end of the tail section is then centered with respect to the launching rod, because of the presence of the part 11.

When the ends of the launching rod and of the piston then come into contact, a centering effect is likewise produced at this level, as a result of the cooperation between the guiding surfaces 2' and 6'. FIG. 1 shows a relative position of these two surfaces being produced at the start of the centering. In the final position, the two conical surfaces 2' and 6' will be in contact over the entire periphery and, in addition, the flat abutment surfaces 2'' and 6'' are also in contact.

It follows that, in the final position:

1. The detonator 8 and the percussion pin are perfectly coaxial, so that the percussion will have to take place through the opening 9, at the centre of the detonator, the opening 9 obviously being chosen so as to permit the passage of the percussion pin without contacting its walls. This precise centering thus avoids the risks initially referred to, as well as wear on the pin and a reduction in the intensity of the percussion;
2. The guiding and abutment surfaces 2', 6' and 2'', 6'' assure a very advantageous distribution of the pressure which the piston will exert on the launching rod at the moment of propulsion. In addition, the piston, generally made of light alloy, which is not as hard as the launching rod, is perfectly adapted to the seating formed by the end of this rod and may even be slightly deformed at this position, without however causing the binding of the conical surfaces.

The constructional form as shown, in which two frustoconical surfaces of like conicity are combined with annular plane surfaces, is proved to be particularly advantageous in this respect, although the respective guiding surfaces may, in principle, have other shapes; for example, they may be ogival. In addition, the rod could have a projecting guiding surface and the piston could have a recess.

Nevertheless, the example which is shown and in which the guiding surface of the rod is concave offers the advantage of obviating the risk of a radial expansion of the piston at the time of launching and, at the very least, the energy losses which would follow.

3. The projectile, being centered at the free end of its tubular part and at the level of the piston, is in a truly coaxial position with respect to the launching rod and this coaxial relationship is maintained throughout the propulsion phase.

FIGS. 2 and 3 show an embodiment of the assembly according to the invention, in the case where the launching means comprise a launching tube.

The projectile 1 is similar to that shown in FIG. 1 and the same elements have thus been designated by the same reference numerals.

The launching tube, indicated at 17, is detachably mounted on a base 19, 19' by means of a support member 20 which is screwed on to the part 19' of the base, and a sleeve 21 fast with the tube 17, the sleeve being fitted on the support member 20 and comprising a bayonet joint device 22.

An essentially cylindrical launching rod is also detachably mounted on the base 19, 19', by means of the support member 20. The free end of the launching rod supports, at its centre, a part 16 which forms a fixed percussion pin. Around this pin, the end of the rod 15 has a frustoconical recess 15', the rim of which is formed by an annular flat surface, in a manner similar to FIG. 1.

In addition, the launching device comprises an arrangement 18 for measuring and controlling the inclination of the tube 17.

For launching purposes, the projectile or missile is introduced into the tube 17 and, as it descends, it is first of all guided by the peripheral parts of its fins and of its fins and of its head. The end 11 of the tail section is then centered in relation to the launching rod and, eventually, the piston is centered with respect to the end of this rod, in a manner similar to that described by reference to FIG. 1. Nevertheless, in the embodiment according to FIGS. 2 and 3, a pre-centering by the launching tube has already occurred before the final centering and the percussion takes place as soon as the projectile has reached its lowest position.

FIGS. 4 and 5 represent a constructional form in which the launching rod is not surrounded by a tube and the projectile is placed directly on this rod. The same reference numerals have been used in these Figures for the elements similar to those of FIG. 1, especially the projectile 1, the launching rod 2 and its support 12.

In this case, the percussion has to be carried out in a controlled manner, once the projectile is in place. FIG. 4 shows diagrammatically the percussion pin 14 mounted on a percussion rod 13 which is subject to the action of a spring and is held by a latch device 26, the position shown being a locking position. As a result of lowering a grip 25 in the form of a sleeve sliding on a tube 23 of the support and fast with the pivot of the device 26, the percussion rod will be freed by the opening of the latch. The tube 23 is fixed on a suitable base 24.

FIG. 5 represents the projectile 1 in a position in which the piston 6 is off-centre to the maximum extent when it comes into contact with the launching rod 2. This situation, which obviously is very frequent in this type of launching arrangement, illustrates the main importance of the centering, firstly as regards the percussion and secondly as regards the propulsion phase. The advantages already emphasised with respect to FIG. 1 are obviously completely included in the arrangement according to FIGS. 4 and 5 and it is clear that the absence of the pre-centering at the position of the projectile head further strengthens the interest of the automatic centering in the present case.

It is to be further noted that the quality of the centering not only makes it possible to compensate for the manufacturing tolerances and the deviations in presentation of the projectile when it is placed in position, but is also maintained, in the preferred constructional form, in the event of wear on the percussion elements.

I claim:

1. Assembly formed by a projectile and a means for launching this projectile, the said means comprising a fixed launching rod having a free end with a percussion pin, and the projectile comprising a projectile head, a tubular tail section, of which one end is fixed to the projectile head and the other end is open, a piston fitted with a primer or detonator and mounted inside the tail section so as to form the movable part of an expansible and closed combustion chamber and a propellent charge disposed inside the said combustion chamber, characterized in that the free end of the launching rod has an axially symmetrical guiding surface which is coaxial with respect to the percussion pin, and the piston has an axially symmetrical guiding surface which is coaxial with respect to the primer or detonator and surrounding an opening for the passage of the percussion pin, these guiding surfaces being conical surfaces of equal concentricity arranged in such manner as to assure the centering of the percussion pin in relation to the detonator and to participate in the establishment of the coaxial relationship of the projectile and of the launching rod during the propulsion phase.

2. Assembly according to claim 1, characterised in that the guiding surface of the launching rod is the internal surface of a conical recess which is open towards the exterior of the rod and the piston comprises a projecting conical part which forms the guiding surface of the piston.

3. Assembly according to claim 1, characterised in that the launching rod and the piston have planar contact surfaces, perpendicular to the axis of the assembly, surrounding the respective guiding surfaces, so as to form the abutment surfaces between the percussion rod and the piston.

* * * * *